US006712009B2

(12) United States Patent
Buntru et al.

(10) Patent No.: US 6,712,009 B2
(45) Date of Patent: Mar. 30, 2004

(54) TABLE WITH FOLDING LEGS

(75) Inventors: Kurt Buntru, Stuehlingen (DE); Harald Hergesell, Goerwihl (DE); Mathias Seiler, Loerrach (DE)

(73) Assignee: Sedus Stoll AG, Waldshut (DE)

( * ) Notice: Subject to any disclaimer, the term of this patent is extended or adjusted under 35 U.S.C. 154(b) by 0 days.

(21) Appl. No.: 10/054,947

(22) Filed: Jan. 25, 2002

(65) Prior Publication Data

US 2003/0140825 A1 Jul. 31, 2003

(51) Int. Cl.[7] ..... A47B 3/00
(52) U.S. Cl. ..... 108/132; 108/115
(58) Field of Search ..... 108/115, 129, 108/130, 131, 132, 133, 27

(56) References Cited

U.S. PATENT DOCUMENTS

| | | | | | |
|---|---|---|---|---|---|
| 1,222,457 | A | * | 4/1917 | Peer | 108/132 |
| 1,300,861 | A | * | 4/1919 | Otte | 108/131 |
| 1,709,927 | A | * | 4/1929 | Whitney | 108/132 |
| 1,723,796 | A | * | 8/1929 | Magnuson | 108/131 |
| 1,967,886 | A | * | 7/1934 | Johnson | 182/129 |
| 2,490,318 | A | * | 12/1949 | Padon | 108/131 |
| 2,872,262 | A | * | 2/1959 | Kline, Sr. | 108/133 |
| 4,462,636 | A | * | 7/1984 | Markson | 108/131 |
| 4,557,200 | A | * | 12/1985 | Geschwender | 108/132 |
| 5,018,628 | A | * | 5/1991 | Schenck et al. | 108/27 |
| 5,325,793 | A | | 7/1994 | Martin | |
| 5,367,962 | A | * | 11/1994 | Tseng | 108/132 |
| 5,947,037 | A | * | 9/1999 | Hornberger et al. | 108/115 |
| 6,123,031 | A | * | 9/2000 | Hayman-Chaffey | 108/27 |
| 6,202,571 | B1 | * | 3/2001 | Pallares | 108/132 |

FOREIGN PATENT DOCUMENTS

| | | |
|---|---|---|
| CH | 125433 | 5/1919 |
| EP | 1 031 737 | 8/2000 |
| FR | 2 415 985 | 8/1919 |
| FR | 2 611 123 | 8/1919 |
| FR | 2630312 | * 10/1989 |
| GB | 1162884 | 8/1919 |

OTHER PUBLICATIONS

Work Table Model by Casala, model No. 6530/6533, 2 pages, Jul. 19, 2000.
Work Table Model by Paustian, model "Tension", 2 pages, Jul. 19, 2000.

* cited by examiner

*Primary Examiner*—Jose V. Chen
(74) *Attorney, Agent, or Firm*—Oblon, Spivak, McClelland, Maier & Neustadt, P.C.

(57) ABSTRACT

A folding table including a folding steel wire frame and a table top. The wire frame includes four vertical struts and four cross-struts, and the table top has a front edge profile connected thereto. The front edge profile pivotably connects to the upper ends of the vertical struts. The vertical struts each connect on their lower ends to rollers in a horizontally non-pivoting manner. The rollers are also connected to the lower ends of the cross-struts in a horizontally pivoting manner. A first anchor plate is arranged on the bottom of the table top for fixably connecting upper ends of two of the cross struts, and a second anchor plate is arranged on the bottom of the table of fixably connecting upper ends of the other two of the four cross struts.

7 Claims, 3 Drawing Sheets

SECTION IV - IV

SECTION V - V

TABLE WITH FOLDING LEGS

FIELD OF THE INVENTION

The invention relates to the field of the furniture industry. It concerns a table with a folding frame and a method for folding the table.

BACKGROUND OF THE INVENTION

Folding tables, which can be folded for space saving reasons during times of non-use or during transport, are known, for example the "Agenda" model by Dauphin or model no. 4950 by Kusch & Co. Due to their design, these familiar folding tables have a high continuous groove, in which a T-shaped folded steel tube frame submerges. The continuous groove and the relatively thick steel tube that is used are the cause for the fact that the folding tables generally have the disadvantage of appearing very bulky.

Tables with a steel wire frame, which exhibit a particular filigree appearance, such as model no. 6530/6533 by Casala or the "Tension" model by Paustian, are also known. The frames of these tables consist of a relatively thin steel wire. Due to the statically beneficial arrangement of the wire struts to the table top, sufficient stability of the frame is achieved despite the small material cross-section.

However, none of the steel wire frame tables available on the market has a folding frame.

SUMMARY OF THE INVENTION

The invention is an attempt to avoid the above-mentioned disadvantage of the familiar state of the art. It is based on the task of developing a table with a folding steel wire frame, which has very much a filigree appearance and can be easily folded.

Based on the invention, this is accomplished on a folding table consisting of a table top and a steel wire frame with four vertical struts and four cross-struts in that the vertical struts on one hand are arranged in a pivoting manner on the top in a table front edge profile that is firmly connected with the table top and on the other hand on the bottom are seated in a horizontally non-pivoting manner in rollers, wherein the vertical struts each are arranged only in half of the rollers and in the other half of the rollers the cross-struts are seated in a horizontally pivoting manner, and wherein the cross-struts at their upper ends are fixed in an anchor plate that is arranged on the bottom of the table top.

The benefits of the invention consist of the fact that with the comparatively thin steel wire a statically beneficial triangle structure of forces is realized, which enables a stable table frame despite two loose joint areas.

It is useful when the anchor plate contains a pan, in which a slotted cylindrical tightening disk with a milled end face and a rubber buffer is arranged in an interlocking manner, wherein the tightening disk can be pressed into the anchor plate with a control lever, which is connected with the anchor plate in a pivoting manner around the horizontal axis via a pin, which is arranged centrically in the pan, and is guided in the penetration area of the anchor plate in a non-pivoting manner due to a square cross-section, wherein the pin is screwed together with a nut on the side of the anchor plate that is allocated to the upper table side and a disk spring is arranged between the nut and the anchor plate. The disk spring beneficially compensates for possible tolerances when moving the control lever and thus ensures that the tightening disk is pressed into the pan of the anchor plate always with a constant force. The rubber buffer of the tightening disk prevents a scratching of the table top during stacking in the folded state.

Furthermore it is useful when the table front edge profile is connected firmly with the table top through a tongue that is arranged in a notch of the table top.

Additionally it is beneficial when the table front edge profile contains a hollow space, in which a bumper strip is arranged. This way damage due to scratching can be avoided, such as that created when the front edges of several tables bump against each other.

Finally it is beneficial when the rollers are covered by rubber hoses because this way damage on the floor due to scratching and during stacking of the tables in the folded state is avoided.

It is also beneficial to use a honeycomb table top because this way the overall weight of the table is especially low.

For the purpose of folding the frame, the control lever must be swiveled by 180° and the tightening disk be swiveled out of the pan, specifically about the axis of rotation of the roller, wherein subsequently the vertical struts and the cross-struts are placed onto the table bottom—flat and unfolded about the axis of rotation of the rollers—so that two of the four rollers rest against the bottom of the table top.

BRIEF DESCRIPTION OF THE DRAWING

The drawing depicts an embodiment of the invention. It shows.

Only elements that are important for gaining an understanding of the invention are shown.

DETAILED DESCRIPTION OF THE INVENTION

The following describes the invention more in detail based on an example and the FIGS. 1 through 7.

Figure 2:
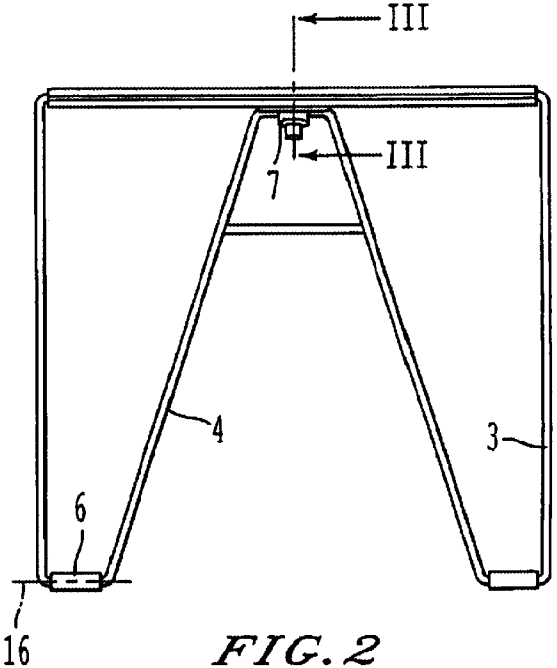
FIG. 2 a side view of the front of an invented folding table.
Figure 1:
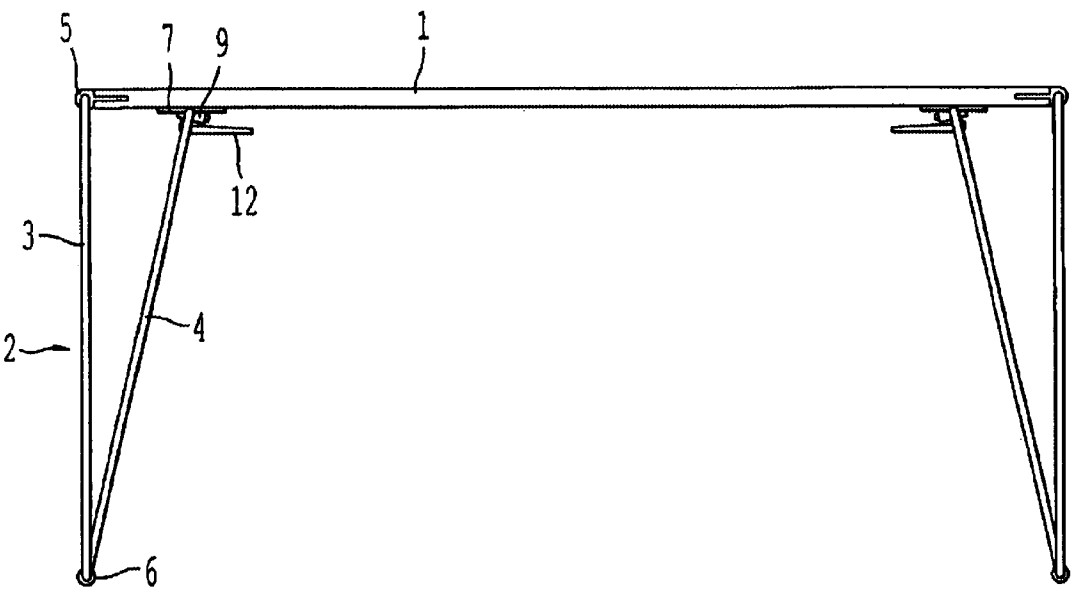
FIG. 1 a side view of the longitudinal side of an invented folding table.

FIG. 1 depicts a side view of the longitudinal side and FIG. 2 a side view of the front of the invented folding table. Both figures should be viewed together for a better understanding. The table consists of a table top 1 and a folding steel wire frame 2 of filigree appearance. The steel wire frame 2 in turn consists of four vertical struts 3 and four cross-struts 4. The vertical struts 3 are seated in a pivoting manner at their upper ends in a table front edge profile 5, which is described more in detail below in FIG. 7. On the bottom, the vertical struts 3 are seated in rollers 6 in a non-pivoting manner. The vertical struts 3, however, are arranged only in half of the rollers 6, i.e. to the middle of the rollers 6. In the other half of the roller 6, the cross-struts 4 are seated in a pivoting manner, i.e., the cross struts 4 are seated in a pivoting manner on their bottom ends. On their upper ends, by contrast they are fixed firmly in the anchor plate 7 on the bottom of the table top 1. This way a triangle structure of forces is created, which makes a very stable table frame possible despite the two loose joint areas. The invented folding table is thus stable, yet has a filigree appearance.

Figure 3:
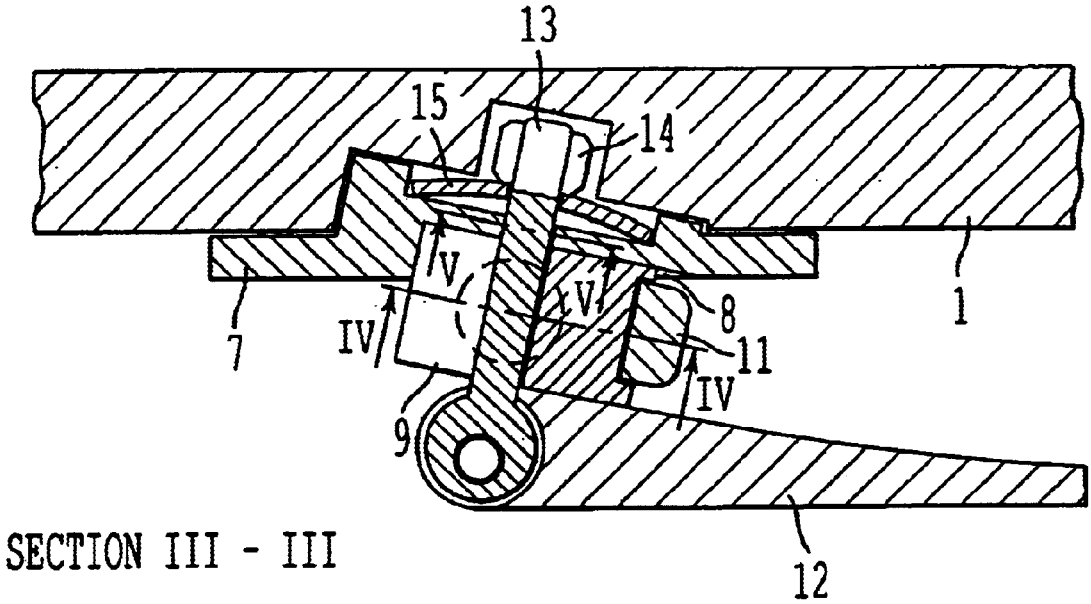
FIG. 3 a section through the anchor plate and tightening disk along the line III—III in FIG. 2.
Figure 4:
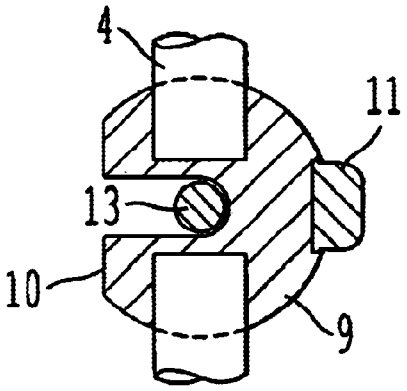
FIG. 4 a section through the tightening disk along the line IV—IV in FIG. 3.

FIG. 3 depicts a section through the anchor plate and tightening disk along the line III—III in FIG. 2, while FIG. 4 shows a section through the tightening disk 9 along the line IV—IV in FIG. 3. These figures explain the anchoring of the cross-strut 4 in the anchor plate 7. For this purpose the anchor plate 7 contains a pan 8, in which a slotted cylindrical tightening disk 9 with a milled end face 10 and a rubber buffer 11 are arranged in an interlocking manner. The tightening disk 9 is pressed into the anchor plate 7 through a control lever 12. The control lever 12 is connected with the anchor plate 7 via a pin 13, which is arranged centrically in the pan 8, in such a way that it can pivot about the horizontal axis.

Figure 5:
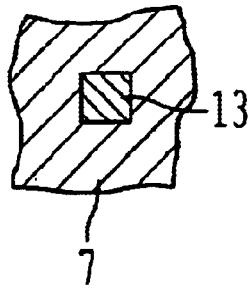
FIG. 5 a section through the anchor plate along the line V—V in FIG. 3.

FIG. 5 shows a section through the anchor plate 7 along the line V—V in FIG. 3. It shows that in the penetration area of the anchor plate 7 the pin 13 takes on a square cross-section so that it is guided in a non-pivoting manner in this area. The pin 13 is additionally screwed together with a nut 14 on the side of the anchor plate 7 that is allocated to the table top 1. Between the nut 14 and the anchor plate 7, a disk spring 15 is arranged. The disk spring 15 compensates for possible tolerances when moving the control lever 12 and thus ensures that the tightening disk 9 is pressed into the pan 8 of the anchor plate always with the same force.

For the purpose of folding the steel wire frame 2, the control lever 12 is swiveled by 180° and the tightening disk 9 is swiveled out of the pan 8 of the anchor plate 7, specifically about the axis of rotation 16 of the rollers 6. Then the vertical struts 3 and the cross-struts 4 are placed on the bottom of the table top 1—flat and unfolded about the axis of rotation 16 of the rollers 6.

Figure 6:
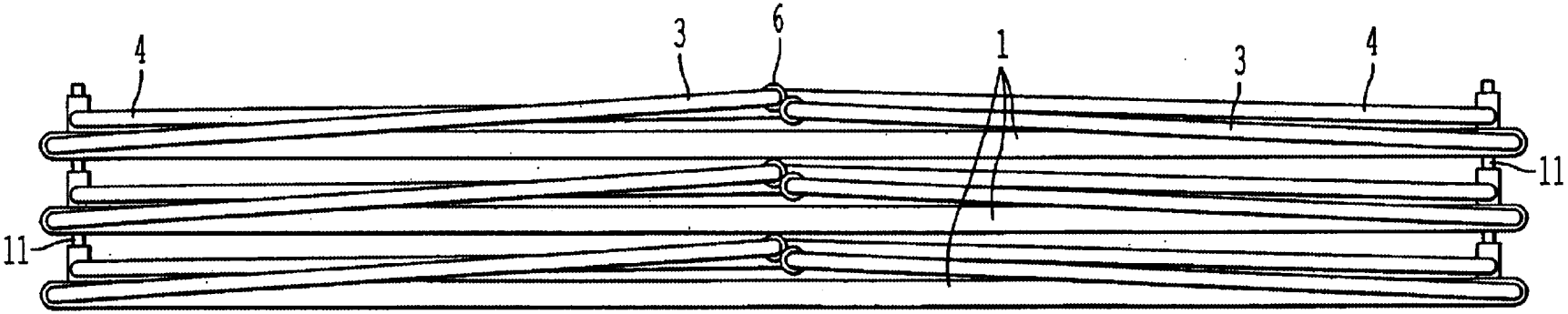
FIG. 6 a side view of three stacked folded tables in accordance with the invention, and FIG. 7 a side view of the table edge profile.

This can be viewed well in FIG. 6, which depicts a side view of three stacked folded tables in accordance with the invention. In the folded state, two of the four rollers 6 rests against the bottom of the table top 1. The other two rollers 6 serve as stacking buffers during the space-saving stacking of the invented folding tables. So as not to scratch the next table top 1 on top, the rollers 6 are covered by a rubber hose. Furthermore, the next table top 1 also rests on top of the rubber buffers 11 of the tightening disks 9. The folding table can thus do without an aesthetically disadvantageous continuous groove into which the folding frame is swiveled.

The vertical struts 3 beneficially serve as carrying handles in the folded state of the tables. The table can thus be transported easily. The use of e.g. honeycomb table tops, which contribute to a lighter weight of the table and therefore make it easier to handle, is also beneficial.

Figure 7:
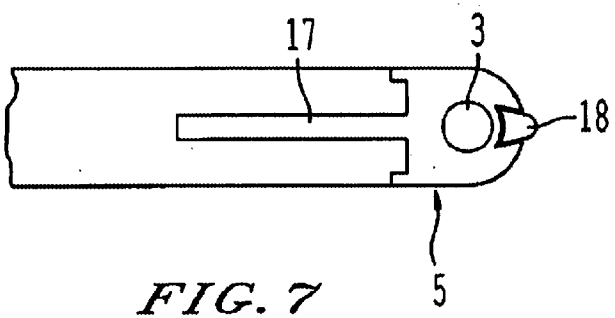

FIG. 7 shows a table front edge profile 5 more in detail. In this table front edge profile 5, the vertical struts 3 are seated in a pivoting manner. The table front edge profile 5 is firmly connected with the table top 1 through a tongue 17 in a slot of the table top 1. It is beneficial if, as shown in FIG. 7, the table front edge profile 5 contains a hollow space, into which a bumper strip 18 is placed. This way damage due to scratching can be prevented, which can be caused when the front edges of the table tops 1 bump against each other.

Of course, the invention is not limited to the described example.

What is claimed is:

1. A folding table, comprising:

a folding steel wire frame including four vertical struts and four cross-struts;

a table top having a front edge profile connected thereto, said front edge profile pivotably connecting upper ends of the four vertical struts;

four rollers each having a first hollow portion for connecting in a horizontally non-pivoting manner lower ends of the four vertical struts and having a second hollow portion for connecting in a horizontally pivoting manner lower ends of the four cross-struts;

a first anchor plate arranged on a bottom of the table top for fixably connecting upper ends of two of the four cross-struts; and a second anchor plate arranged on the bottom of the table for fixably connecting upper ends of the other two of the four cross-struts.

2. The folding table according to claim 1, wherein the first and second anchor plates comprise:

a pan including a slotted cylindrical tightening disk with a milled end face and a rubber buffer arranged in an interlocking manner;

a control lever pivotably attached about a horizontal axis of a respective anchor plate;

a pin centrically arranged in said pan and having a square cross-section at a point of penetration of the respective anchor plate to prevent pivoting, and screwed together with a nut on a side of the respective anchor plate adjacent to the table top; and a disk spring arranged between said nut and said respective anchor plate, wherein said control lever is attached to said respective anchor plate via said pin, and wherein said cylindrical tightening disk is pressed into said respective anchor plate with said control lever so as to engage respective upper ends of said cross-struts.

3. The folding table according to claim 1, wherein the table top includes a slot for receiving a tongue of the front edge profile such that said front edge profile is connected with the table top.

4. The folding table according to claim 1, wherein said front edge profile further comprises a bumper stripper arranged in a hollow space in said front edge profile.

5. The folding table according to claim 1, wherein said four rollers include a rubber hose covering.

6. The folding table according to claim 1, wherein said table top is of a honeycomb design.

7. A method of folding a table including a folding steel wire frame having four vertical struts and four cross-struts; a table top having a front edge profile connected thereto, said front edge profile pivotably connecting upper ends of the four vertical struts; four rollers each having a first hollow portion for connecting in a horizontally, non-pivoting manner lower ends of the four vertical struts and having a second hollow portion for connecting in a horizontally pivoting manner lower ends of the four cross-struts; a first anchor plate arranged on a bottom of the table top for fixably connecting upper ends of two of the four cross-struts; and a second anchor plate arranged on the bottom of the table for fixably connecting upper ends of the other two of the four cross-struts, wherein the first and second anchor plates comprise a pan including a slotted cylindrical tightening disk with a milled end face and a rubber buffer arranged in an interlocking manner, a control lever pivotably attached about a horizontal axis of a respective anchor plate, a pin centrically arranged in said pan and having a square cross-section at a point of penetration of the respective anchor plate to prevent pivoting, and screwed together with a nut on a side of the respective anchor plate adjacent to the table top, and a disk spring arranged between said nut and said respective anchor plate, wherein said control lever is attached to said respective anchor plate via said pin, and wherein said cylindrical tightening disk is pressed into said respective anchor plate with said control lever so as to engage respective upper ends of said cross-struts, said method comprising the steps of:

swiveling the control lever by 1800;

swiveling the tightening disk out of the pan about the axis of rotation of a respective roller, and thereby disengaging an upper end of a respective cross-strut; and placing a respective vertical strut and a respective cross-strut against the bottom of the table top, flat and unfolded about the axis rotation of the rollers, such that two of the four rollers rest against the bottom of the table top.

* * * * *